United States Patent [19]

Houdeshell

[11] 4,114,482

[45] Sep. 19, 1978

[54] MULTIPLE USE ADAPTERS FOR PLIERS

[76] Inventor: Donald D. Houdeshell, RR #2, Republic, Ohio 44867

[21] Appl. No.: 810,386

[22] Filed: Jun. 27, 1977

[51] Int. Cl.[2] ..... B25B 7/02

[52] U.S. Cl. ..... 81/421; 269/271; 81/425 R

[58] Field of Search .....81/418, 421–426, 81/5.1; 29/268, 229; 269/271

[56] References Cited

U.S. PATENT DOCUMENTS

| | | | |
|---|---|---|---|
| 298,872 | 5/1884 | May | 81/421 |
| 3,390,445 | 7/1968 | Sova | 29/268 |
| 3,647,186 | 3/1972 | Hartman | 81/425 R |
| 3,650,008 | 4/1972 | Plouffe | 81/425 R |
| 3,990,137 | 11/1976 | Kulba et al. | 29/229 |

*Primary Examiner*—James L. Jones, Jr.
*Attorney, Agent, or Firm*—Clarence A. O'Brien; Harvey B. Jacobson

[57] ABSTRACT

A pair of elongated jaw adapter members are provided for use in conjunction with a pair of jaw members relatively supported for movement toward and away from each other and including opposing serrated clamping surfaces and remote oppositely facing surfaces. The adapter members are removably abutted against and include remote serrated faces meshed with the serrated opposing surfaces of the jaw members. Each adapter member includes a bail member having a pair of generally parallel legs with a bight portion extending between and interconnecting a first pair of ends of the legs. The other pair of ends of the legs are pivotally anchored to opposite side portions of the corresponding adapter member for angular displacement relative thereto about an axis extending between the legs and the legs embracingly receive the corresponding jaw member therebetween. The bight portion of each bail member includes a set screw threadedly engaged therewith and removably clamping the engaged with the corresponding surface of the aforementioned remote surfaces of the jaw members. Each of the adapter members has a work engaging member engaged therewith whereby a suitable workpiece may be engaged, in an operative manner, by the adapter members.

7 Claims, 9 Drawing Figures

MULTIPLE USE ADAPTERS FOR PLIERS

BACKGROUND OF THE INVENTION

Various forms of adapters for relatively movable jaw members have been heretofore provided. However, these previously known forms of adapters generally require jaw members specifically designed therefor. Accordingly, most adapters cannot be readily mounted on wrenches or pliers having relatively movable jaws and which are of conventional design.

Accordingly, a need exists for jaw adapters which may be readily removably mounted on conventional jaw members.

Examples of various forms of jaw adapters including some of the general structural and operational features of the instant invention are disclosed in U.S. Pat. Nos. 527,132, 869,527, 1,048,937, 1,892,082, 2,814,222, 3,040,420 and 3,647,186.

BRIEF DESCRIPTION OF THE INVENTION

The adapters of the instant invention are designed for use in conjunction with the relatively movable jaws of various forms of pliers and adjustable wrenches.

The adapters include serrated faces adapted to abut against and mesh with serrated faces of the corresponding jaw members and each adapter includes a bail pivotally supported therefrom for embracingly engaging the corresponding jaw member and including a set screw threadedly supported therefrom for clamped engagement with the corresponding jaw member. In this manner, the adapters of the instant invention may be readily mounted on various forms of conventional jaw members.

The main object of this invention is to provide a pair of adapters which may be utilized in conjunction with various forms of conventional pliers or adjustable wrench jaw members.

Another object of this invention is to provide adapters constructed in a manner whereby various different forms of work engaging elements may be supported therefrom or engaged thereby in order to manipulate various types of workpieces.

Still another object of this invention is to provide adapters constructed in a manner whereby they may be supported from the associated jaws against slipping relative thereto.

Another important object of this invention is to provide a pair of adapters which may be readily applied to and removed from associated jaw members whenever desired.

A final object of this invention to be specifically enumerated herein is to provide a pair of adapters in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
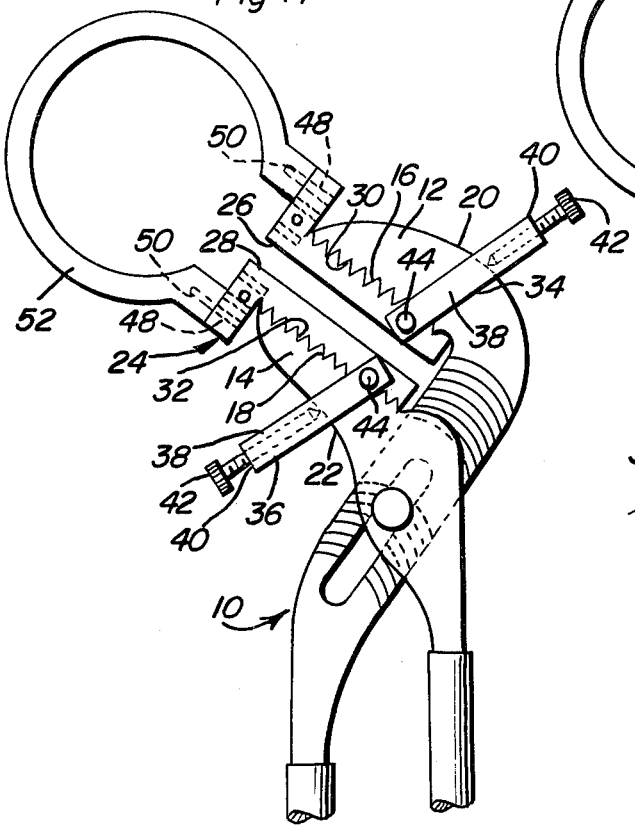
FIG. 1 is a fragmentary elevational view of a pair of adjustable pliers with a first form of adapter construction operatively associated with the jaws thereof.
Figure 2:
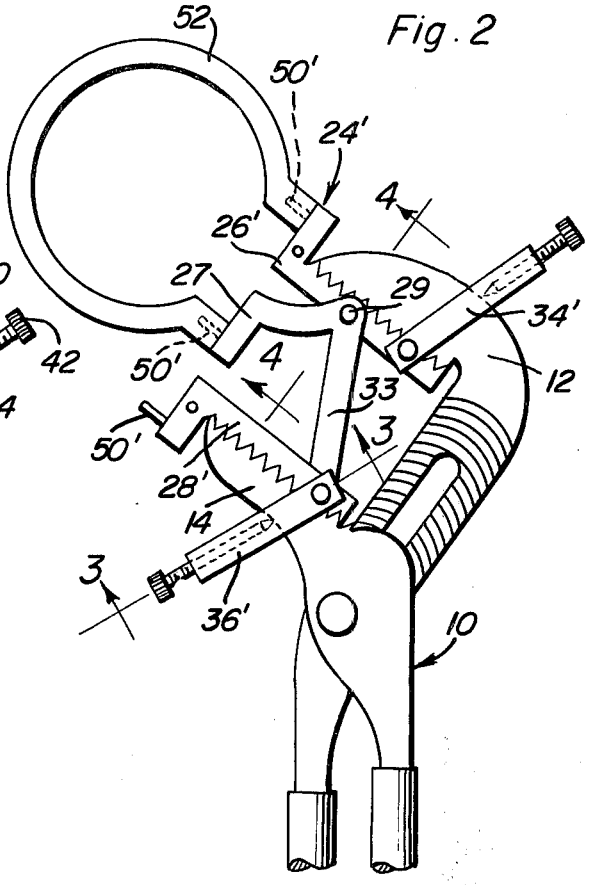
FIG. 2 is a side elevational view similar to FIG. 1 but with a second form of adapter operatively associated with the jaws of the pliers.
Figure 3:
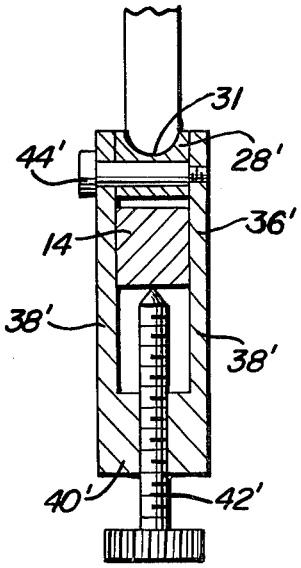
FIG. 3 is an enlarged fragmentary sectional view taken substantially upon the plane indicated by the section line 3—3 of FIG. 2.
Figure 4:
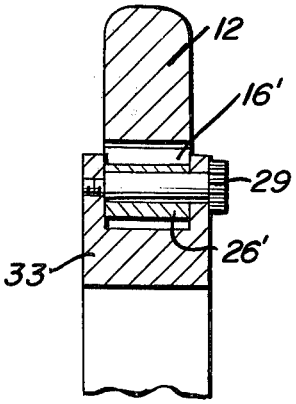
FIG. 4 is a fragmentary enlarged sectional view taken substantially upon the plane indicated by the section line 4—4 of FIG. 2.
Figure 5:
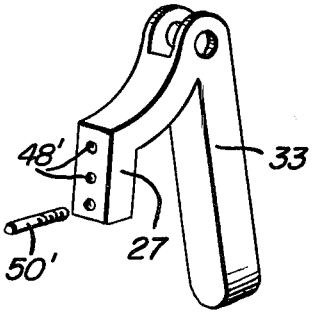
FIG. 5 is a perspective view of a portion of one of the adapter members illustrated in FIG. 2.
Figure 6:
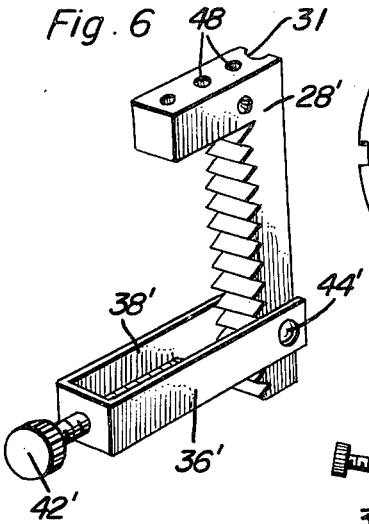
FIG. 6 is a perspective view of the other adapter member illustrated in FIG. 2.

Referring now more specifically to FIG. 1 of the drawings, there may be seen a conventional form of adjustable pliers referred to in general by the reference numeral 10. The pliers 10 include relatively movable jaws 12 and 14. The jaws 12 and 14 include serrated opposing faces 16 and 18 and opposedly facing remote surfaces 20 and 22.

A first form of adapter is referred to in general by the reference numeral 24 and includes a pair of elongated adapter members 26 and 28. The adapter members 26 and 28 include remote serrated faces 30 and 32 abutted against and disposed in meshed engagement with the surfaces 16 and 18.

The adapter members 26 and 28 include similar bails 34 and 36 and each bail 34 and 36 includes a pair of parallel legs 38 interconnected at one pair of ends by means of a bight portion 40 through which a set screw 42 is threadedly engaged. The ends of the legs 38 remote from the bight portion 40 of each bail 34 are pivotally attached to the corresponding adapter member by means of a pivot fastener 44, the bail of each adapter member 26 and 28 receiving the corresponding adapter member between the legs thereof as well as the corresponding jaw of the pliers 10. The set screws 42 of the bails 34 and 36 are threaded inwardly into engagement with the remote oppositely facing surfaces 20 and 22 of the jaws 12 and 14 whereby the adapter members 26 and 28 are securely fastened to the jaws 12 and 14.

Each of the adapter members 26 and 28 has a plurality of threaded bores 48 formed therein and one pair of the bores 48 has a pair of work engaging pins 50 threadedly engaged therein and the pins 50 may be suitably engaged with a workpiece such as the snap ring 52 illustrated in FIG. 1.

With attention now invited more specifically to FIGS. 2–6 of the drawings, there may be seen a modified form of adapter referred to in general by the reference numeral 24' and which includes features similar to the various features of the adapter 24 and which are therefore designated by corresponding prime numerals.

The adapter 24' differs from the adapter 24 in that the adapter member 26' thereof has a third adapter member 27 pivotally supported therefrom as at 29. In addition, the adapter member 28' has a concave channel 31 formed in its side opposing the adapter member 26' and the third adapter member includes a lever arm 33 whose free end is slidingly received in the channel. Accordingly, the pins 50 supported from the adapter members 26 and 28 are adapted to squeeze the ends of the snap ring 52 together and the pins 50' carried by the adapter members 26' and 27 are adapted to spread the opposite ends of the snap ring 52 apart.

Figure 7:
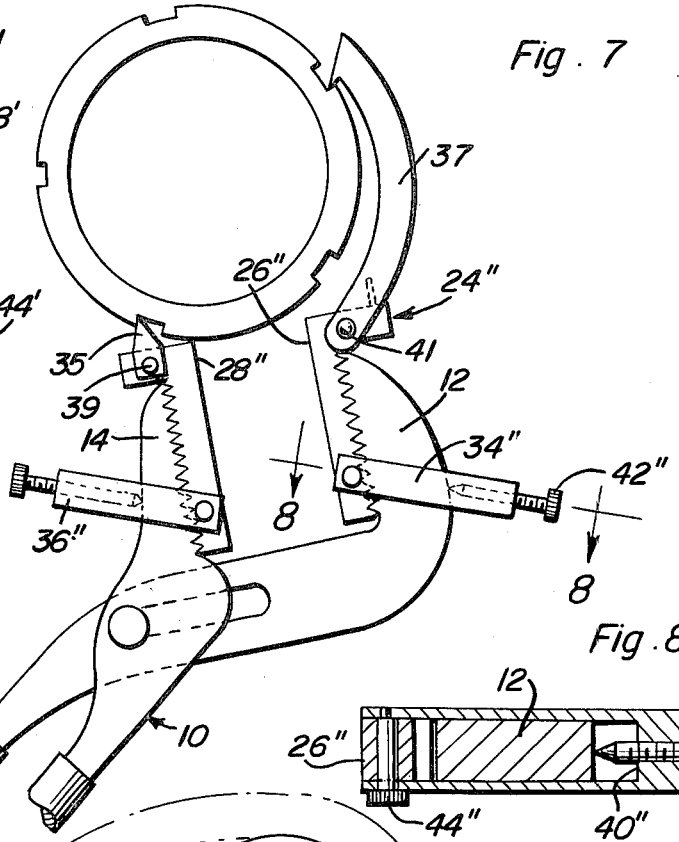
FIG. 7 is a side elevational view similar to FIG. 1 but illustrating the adapters members thereof provided with different work engaging members.
Figure 8:
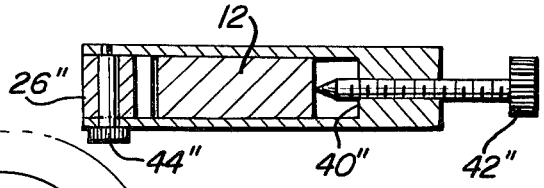
FIG. 8 is an enlarged fragmentary sectional view taken substantially upon the plane indicated by the section line 8—8 of FIG. 7.

With attention now invited more specifically to FIG. 7 of the drawings, there may be seen a third form of adapter 24''. The adapter 24'' is substantially identical to the adapter 24, except that the adapter members 26'' and 28'' thereof have spanner wrench jaws 35 and 37 supported therefrom. The spanner wrench jaw 35 is supported from the adapter member 28'' by means of a fastener 39 and the jaw 37 is pivotally attached to the adapter member 26'' by means of a pivot fastener 41.

Figure 9:
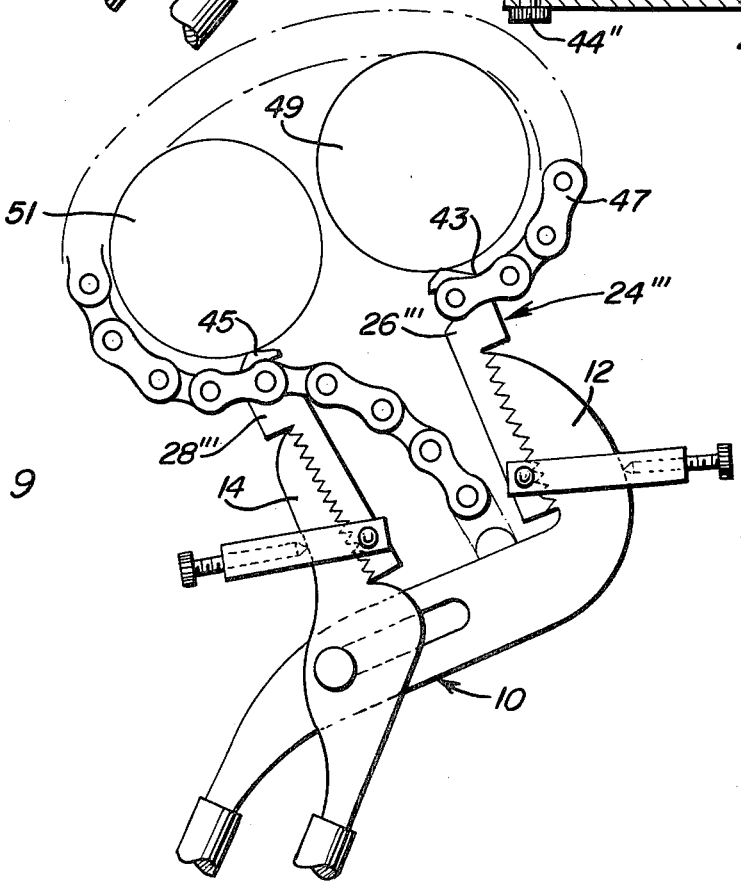
FIG. 9 is a fragmentary side elevational view of a pair of pliers with a third pair of adapter members supported therefrom.

With attention now invited to FIG. 9 of the drawings, still another form of adapter referred to in general by the reference numeral 24''' is illustrated. The adapter 24''' differs from the previously disclosed adapters in that the adapter members 26''' and 28''' thereof define hooked ends 43 and 45 which may be removably engaged with selected links of a link chain section 47. As can be seen from FIG. 9 of the drawings, the link chain section 47 may be utilized to clampingly secure a plurality of articles 49 and 51 together.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a pair of jaw members relatively supported for movement toward and away from each other and including opposing serrated clamping surfaces and remote oppositely facing surfaces, a pair of jaw adapter members having serrated remote faces, said adapter members being removably abutted against said clamping surfaces with the serrations thereof meshed with the serrations of said remote faces, a pair of bail members each including a pair of generally parallel legs having first and second pairs of corresponding ends and a bight portion extending between and interconnecting said first pair of corresponding ends, the second pair of ends of each bail member embracingly receiving a corresponding adapter member therebetween and being pivotally anchored thereto for angular displacement about an axis extending between said second pair of ends, said legs also receiving the corresponding jaw member therebetween and each of said bight portions including a set screw threadedly secured therethrough and clamped against the corresponding surface of said remote surfaces, each of said adapter members having a work engaging member engaged therewith.

2. The combination of claim 1 wherein said work engaging members comprise anchor hook portions to which longitudinally spaced portions of a roller chain may be releasably anchored.

3. The combination of claim 1 wherein said work engaging members comprise spanner wrench jaw portions.

4. The combination of claim 1 wherein said work engaging members comprise snap ring engaging pin portions.

5. The combination of claim 4 wherein said snap ring engaging portions are each stationarily supported from a corresponding adapter member.

6. The combination of claim 4 wherein said snap ring engaging portions include a first pin portion stationarily supported from one of said adapter members and a second pin portion pivotally supported from said one adapter member and including a lever arm portion slidingly engaged with the other of said adapter members for swinging of said second pin portion away from said first pin portion in response to movement of said jaw members and adapter members toward each other.

7. The combination of claim 6 wherein said other of said adapter members includes means defining an elongated groove extending therealong opposing said one adapter member and on which the free end of said lever arm portion is slidingly engaged.

* * * * *